US006878511B2

(12) United States Patent
Ohzeki et al.

(10) Patent No.: US 6,878,511 B2
(45) Date of Patent: Apr. 12, 2005

(54) PROCESS OF PRODUCING SILVER HALIDE PHOTOGRAPHIC EMULSIONS

(75) Inventors: Katsuhisa Ohzeki, Kanagawa (JP); Tetsuro Mitsui, Kanagawa (JP); Haruyasu Nakatsugawa, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/422,937

(22) Filed: Apr. 25, 2003

(65) Prior Publication Data

US 2003/0232292 A1 Dec. 18, 2003

(30) Foreign Application Priority Data

Apr. 26, 2002 (JP) ..... P. 2002-126870

(51) Int. Cl.[7] ..... G03C 1/005; G03C 1/494
(52) U.S. Cl. ..... 430/567; 430/569; 430/449
(58) Field of Search ..... 430/449, 567, 430/569

(56) References Cited

U.S. PATENT DOCUMENTS 6,645,713 B2 * 11/2003 Saito ..... 430/569

FOREIGN PATENT DOCUMENTS

JP 2000-338620 A 12/2000
JP 2001-290231 A 10/2001

* cited by examiner

*Primary Examiner*—Geraldine Letscher
(74) *Attorney, Agent, or Firm*—Sughrue Mion, PLLC

(57) ABSTRACT

A process of producing a silver halide photographic emulsion containing tabular silver halide grains having an aspect ratio of 5 or more, which comprises using silver halide fine grains as prepared by the following method in at least one of a nucleation step and a growth step of the production of silver halide emulsion, the method comprising mixing at least a silver salt aqueous solution and a halide aqueous solution to prepare silver halide fine grains, wherein one of the silver salt aqueous solution and the halide aqueous solution is introduced as a jet flow into a mixer; a region where the jet flow slows down is provided within the mixer; and the other solution is introduced into the jet flow before the velocity of the jet flow has become 1/10 of the velocity at the time when the jet flow comes into the slowing-down region.

17 Claims, 1 Drawing Sheet

PROCESS OF PRODUCING SILVER HALIDE PHOTOGRAPHIC EMULSIONS

FIELD OF THE INVENTION

The present invention relates to a process of producing silver halide photographic emulsions of photographic light-sensitive materials and to silver halide light-sensitive materials produced using the process. In particular, the invention relates to a method of obtaining thinner silver halide tabular grain emulsions.

BACKGROUND OF THE INVENTION

The manufacture of silver halide photographic emulsions is usually carried out by adding silver ions and halide ions within a reactor equipped with a stirrer. The initial addition causes nucleation, and the sequent addition causes crystal growth.

Preferred silver halide grains to be used in emulsions for light-sensitive material are grains having high monodispersity of size and uniformity of shape. For this purpose, one of functions required for stirring machines is to realize uniform mixing instantaneously and microscopically.

The stirring method includes various methods as described in, for example, JP-A-7-219092 (the term "JP-A" as used herein means an "unexamined published Japanese patent application"), JP-A-8-171156, JP-A-4-283741, JP-B-8-22739 (the term "JP-B" as used herein means an "examined Japanese patent publication"), and U.S. Pat. No. 3,782,954. However, in the case where the nucleation is carried out by such methods, even by employing any of the foregoing methods, the liquid is circulated within the reactor, and nucleation and nuclear growth take place in parallel, so that it is difficult to form monodispersed nuclei. For example, in the field of silver halide photography, in order to enhance light-receiving efficiency, tabular silver halide grains having a large light-receiving area are widely used as a light-sensitive element. However, in the foregoing methods, there is caused an obstacle such that during circulation of the silver halide grains within the reactor, the tabular silver halide grains that go on the way of growth pass through a high supersaturation region in the vicinity of a port of adding the silver ions or halide ions to increase the thickness of the tabular grains or cause polydispersion of the grain size, resulting in lowering of the light-receiving efficiency. Incidentally, the tabular silver halide grain is characterized by a ratio of equivalent circular diameter (diameter of a circle having the same projected area as grain) to grain thickness, i.e., an aspect ratio.

In order to solve these problems, there is a method in which besides the reactor, an external mixer is provided, silver halide fine grains are formed by the external mixer, and the formed silver halide fine grains are added in the reactor, thereby undergoing a part or the whole of the nucleation step or growth step. According to this method, a silver salt aqueous solution, a halide aqueous solution and a dispersion medium aqueous solution are added in the external mixer to continuously form fine grains. The fine grains can be used for the nucleation and/or growth. In such a method, it is desired to completely mix the added solutions in the external mixer within a short period of time as far as possible and discharge the formed fine grains out the external mixer as fast as possible. It is not preferred that a long period of time is needed for mixing or the added solutions are circulated within the external mixer.

In U.S. Pat. No. 5,250,403 or JP-A-10-43570, a method of mixing by a stirring blade in a small-volume mixer is described. However, in such a method, the added solutions are circulated in the mixer.

In JP-A-4-139440 and JP-T-6-507255 the term "JP-T" as used herein means a "published Japanese translation of a PCT patent application"), the added solutions are not circulated because mixing is carried out without mechanical stirring. However, according to these methods, a mixing force is not satisfactory because strong stirring is not performed. U.S. Pat. No. 5,104,786 or JP-A-11-38539 discloses a method in which two solutions are mixed within a pipe. In this case, the added solutions are not circulated. However, because of a so-called plug flow in which the solutions flow in a constant direction, the mixing cannot help relying on the generation of a turbulent flow accompanied with a high-speed flow. In order to generate a sufficient turbulent flow by the plug flow, it is necessary to continue a very high-speed flow, and such involves difficulty.

In order to keep a sufficient mixing force without mechanical stirring, there is a method in which the added solutions are made a linear jet flow, and mixing is carried out by its kinetic energy. JP-8-A-334848 discloses a process of production of silver halide photographic emulsions utilizing such a kinetic energy of jet flow. However, this patent document is concerned with a process of production of silver halide photographic emulsions by a single jet process, and the internal circulation time of the added solutions is large. In addition, since the kinetic energy as used therein is insufficient to perform mixing the whole of the reactor, mechanical stirring is jointly employed.

JP-A-2000-338620 or JP-A-2001-290231 discloses that at least one of a silver salt aqueous solution and a halide aqueous solution is made a high-speed linear jet flow (straight flow), and the two solutions are mixed within a short period of time to continuously form silver halide grains. However, even by utilizing the high-speed flow, such is still insufficient for microscopic mixing, and further improvements have been demanded.

SUMMARY OF THE INVENTION

An object of the invention is to make it possible to form uniform grains and to obtain a silver halide photographic emulsion containing monodispersed tabular silver halide grains, especially thin and monodispersed tabular silver halide grains.

Another object of the invention is to obtain a high-sensitivity photographic light-sensitive material using the silver halide emulsion containing such tabular silver halide grains.

The foregoing objects of the invention have been achieved by the following processes.

(1) A process of producing a silver halide photographic emulsion containing tabular silver halide grains having an aspect ratio of 5 or more, which comprises using silver halide fine grains as prepared by the following method in at least one of a nucleation step and a growth step of the production of silver halide emulsion, the method comprising mixing at least a silver salt aqueous solution and a halide aqueous solution to prepare silver halide fine grains, wherein one of the silver salt aqueous solution and the halide aqueous solution is introduced as a jet flow into a mixer; a region where the jet flow slows down is provided within the mixer; and the other solution is introduced into the jet flow before the velocity of the jet flow has become 1/10 of the velocity at the time when the jet flow comes into the slowing-down region.

(2) A process of producing a silver halide photographic emulsion containing tabular silver halide grains having an aspect ratio of 5 or more, which comprises using silver halide fine grains as prepared by the following method in at least one of a nucleation step and a growth step of the production of silver halide emulsion, the method comprising introducing at least two solutions into a mixer to prepare silver halide fine grains, wherein the mixer is provided with at least two introduction ports and at least one discharge port; a first solution is introduced as a jet flow from a first introduction port; the mixer is provided with a region where the jet flow slows down; a second solution is introduced from a second introduction port as a flow having a vector in the vertical direction to the jet flow of the first solution; an inner diameter of the mixer is larger than an inner diameter of each of the introduction ports to generate the maximum velocity of each of the introduced solutions; the discharge port of the mixer has an inner diameter smaller than the inner diameter of the mixer; and the introduction port of the second solution is provided in a position at which a velocity Vz of the jet flow of the first solution in the direction (Z direction) where the jet flow of the first solution introduced exhibits the maximum velocity meets the following requirement:

$$(1/10)Vz0<Vz<Vz0$$

wherein Vz0 represents a velocity in the Z direction when the jet flow comes into the slowing-down region.

(3) A process of producing a silver halide photographic emulsion containing tabular silver halide grains having an aspect ratio of 5 or more, which comprises using silver halide fine grains as prepared by the following method in at least one of a nucleation step and a growth step of the production of silver halide emulsion, the method comprising introducing at least two solutions into a mixer to prepare silver halide fine grains, wherein a first solution is introduced as a jet flow; and a second solution is introduced before the eddy viscosity of the jet flow becomes maximum.

(4) The process of producing a silver halide photographic emulsion as set forth in any one of (1) to (3) above, wherein the silver halide fine grains have a number average equivalent circular diameter of 15 nm or less and a variation coefficient of the equivalent circular diameter of 30% or less.

(5) The process of producing a silver halide photographic emulsion as set forth in any one of (1) to (3) above, wherein the silver halide fine grains have a rate of number of twin crystal grains of 15% or less.

(6) The process of producing a silver halide photographic emulsion as set forth in any one of (1) to (3) above, wherein the silver halide fine grains have a molar concentration of 0.5 mol/L or more.

(7) The process of producing a silver halide photographic emulsion as set forth in any one of (1) to (3) above, wherein when two kinds of the solutions are mixed, a Br ion concentration pBr is controlled.

(8) The process of producing a silver halide photographic emulsion as set forth in (7) above, wherein the pBr is from 1.0 to 5.0.

(9) A silver halide photographic emulsion containing tabular silver halide grains having an aspect ratio of 5 or more as produced according to any one of the processes as set forth in (1) to (8) above.

(10) A silver halide light-sensitive material containing the silver halide photographic emulsion as set forth in (9) above.

DETAILED DESCRIPTION OF THE INVENTION

Figure 1:
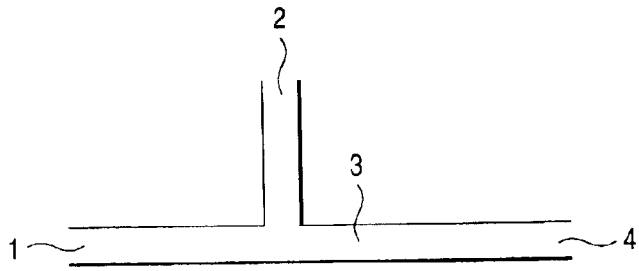
FIG. 1 PRIOR ART
FIG. 1 is a schematic view (side cross-sectional view) showing a configuration of emulsion production system in the prior art.

Substances are mixed by two factors of a so-called flow (hereinafter referred to as "mean flow") and an eddy (hereinafter referred to as "eddy flow") in the direction different from the mean flow. In order to obtain a high stirring efficiency in a fine region, it is necessary to undergo mixing by an eddy flow. In the case where the eddy flow is generated by the flow velocity using the conventional method as disclosed in, for example, U.S. Pat. No. 5,104,786 as cited above, even by using an apparatus having a Reynolds number in an order of several ten thousands, it may not be said that the mixing is sufficient. On the contrary, it has been found that in the grain formation according to the invention, by slowing down the flow velocity within a short period of time, it is possible to convert the kinetic energy of the fluid from the mean flow into the eddy flow, thereby greatly enhancing the stirring and mixing efficiency. Accordingly, a preparation apparatus of silver halide fine grains according to the invention has a structure to enable to slow down a jet flow (first solution) having a high velocity within a short period of time and an introduction port of a solution (second solution) to be mixed before the jet flow slows down, where the second solution can come into contact with the jet flow.

The higher the velocity of the jet flow, the larger the generation of the eddy flow at the slowing-down time and the more advantageous the mixing. Accordingly, in the conventional techniques, it has been considered to be desirable that the velocity of the jet flow is as high as possible. However, in order to generate a high velocity of the jet flow, it has been required to generate a high pressure. According to the invention, the jet flow having a high velocity is introduced in the slowing-down region at a flow velocity of 10 m/sec or more, preferably from 10 m/sec to 360 m/sec, and especially preferably from 30 m/sec to 100 m/sec from an introduction port having a small-size diameter. The effects of the invention reside in the point that even in the case where an incident velocity of the jet flow into the slowing-down region is comparatively low, the high mixing efficiency is obtained. Thus, a load on the manufacture is greatly reduced.

The slowing-down region for generation of the eddy flow as referred to herein means a region where it has a cross-sectional area Im larger than a diameter Ij of the introduction port of the jet flow, thereby enabling to slow down the jet flow. An Im/Ij ratio is preferably 2 or more, and especially preferably from 10 to 1,000.

The introduction port of the jet flow may be single or plural (n number), but it is preferred that the Im/Ij ratio falls within the above-described range. Further, it is preferred that eddy flows generated during the time when plural jet flows slow down overlap each other. This is because the overlap of the eddy flows promotes the mixing.

The shape of the introduction port of the jet flow may be circular or in a slit-like form.

The position of the introduction port of the second solution is important. When the advancing direction of the jet flow is defined as the Z direction, the velocity of the jet flow in the Z direction is defined as Vz, and the velocity of the jet flow at the time when it comes into the slowing-down region is defined as Vz0, the center of the introduction port of the second solution should be positioned in the Z direction within a range where Vz meets the following requirement:

$$(1/10)Vz0<Vz<Vz0$$

The second solution may be provided just before the discharge port of the jet flow.

The velocity of the jet flow can be determined, for example, by incorporating a substance functioning as a marker into the fluid and optically detecting its movement. Further, in recent years, a numerical flow analysis technique makes progress, and a dynamic equation of fluid can be solved by a finite difference method.

Figure 2:
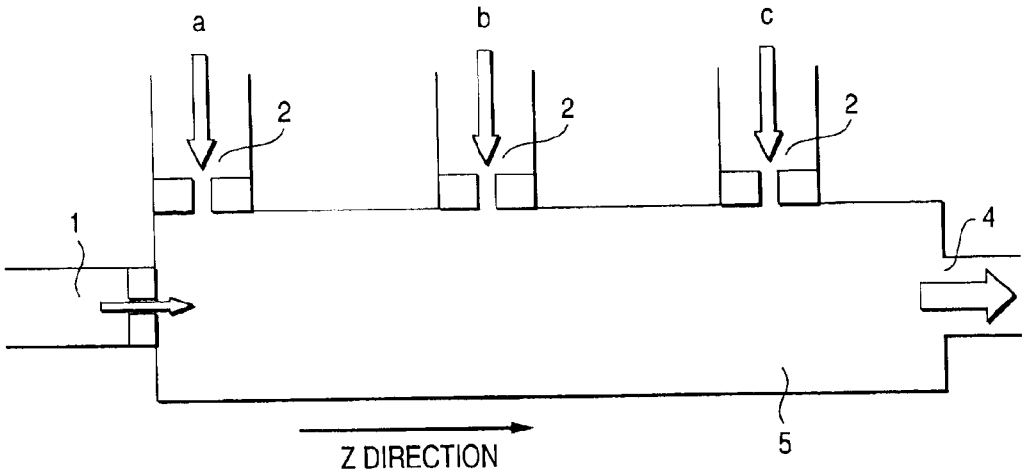
FIG. 2 is a schematic view (side cross-sectional view) showing a configuration of emulsion production system according to the invention.

The addition port of the second solution may be single or plural, but it is preferred that the second solution has a flow rate such that the slowing-down of the jet flow is not obstructed. The invention is described with reference to the accompanying drawings. FIG. 1 is a schematic view showing a conventional method, in which a first solution and a second solution are introduced from introduction ports 1 and 2, respectively, and since a diameter of a pipe (portion 3) after the introduction is small, the mixed solution is discharged from a discharge port 4 while the flow velocity does not slow down. Accordingly, a sufficient stirring effect is not obtained. FIG. 2 is a schematic view showing an embodiment of the invention, in which a jet flow is introduced from an introduction port 1 of jet flow and rapidly slows down in a slowing-down region 5. A second solution is introduced before the slowing-down from an introduction port 2 and thoroughly mixed by a high eddy flow effect generated during the slowing-down, and the mixed solution is discharged from a discharge port 4. However, in the case where the second solution is introduced after the first solution has slowed down sufficiently, the effects of the invention are not obtained. Accordingly, the introduction port 2 of the second solution should be present in the vicinity of the introduction port 1 of the first solution.

In the case where mixing is carried out by the jet flow having a high flow velocity, a high kinetic energy of the jet flow not only converts the straight flow into the eddy flow but also is converted into a heat energy. Thus, the temperature of the mixed solution elevates. Although the invention intends to form finer grains, the elevation of temperature causes an increase of solubility of silver halide and results in increase in the grain size. In order to prevent such an undesired temperature elevation, it is desired to previously make temperature of the added solution low. The temperature of the added solution (silver nitrate aqueous solution and/or halide aqueous solution) is preferably 20° C. or lower, more preferably 10° C. or lower, and most preferably 5° C. or lower. Further, it is preferred to cool a portion where the jet flow is formed. The cooling temperature is preferably 20° C. or lower, and more preferably 5° C. or lower.

As the halide aqueous solution that is used in the manufacture of emulsion of the invention, an aqueous solution of potassium bromide, sodium bromide, potassium chloride, sodium chloride, potassium iodide, sodium iodide, or a mixture thereof is used depending on the tabular silver halide emulsion grains to be formed. In the case where the silver halide grains obtained by the process of the invention are used as nuclei, the concentrations of the silver salt solution and of the halide aqueous solution are preferably 4 mol/L or less, more preferably 1 mol/L or less, and most preferably 0.2 mol/L or less. In the case where the silver halide grains obtained by the process of the invention are used in the crystal growth, it is preferred from the viewpoint of productivity to use high-concentration silver salt solution and halide solution. The concentrations of the solutions are preferably from 0.5 mol/L to 4 mol/L, and more preferably from 1.0 ml/L to 4 mol/L. When the silver halide grains obtained by the process of the invention are added in a reactor to undergo the grain growth by Ostwald ripening, temperature of the emulsion in the reactor is preferably 40° C. or higher, more preferably 60° C. or higher, and still more preferably 70° C. or higher and 100° C. or lower. The reaction between silver nitrate and halide is an exothermic reaction, and when both are mixed, the temperature of the reaction mixture rises, and an increase in grain size is observed. In order to inhibit this phenomenon, it is also preferred to control the temperatures of the added solutions and the portion where the jet flow is formed as described above.

Preferably, in the invention, gelatin as a protective colloid is contained in at least one of the silver salt aqueous solution and the halide aqueous solution. Since the gelatin greatly influences the size of silver halide grains formed and the twinning probability in the silver halide grains, a preferred concentration of the aqueous gelatin solution varies depending on the purpose of use of the silver halide fine grains formed.

In the case where the silver halide fine grains continuously formed by the invention are used as nuclei for the preparation of tabular silver halide grains, since parallel double twin crystal nuclei are necessary, it is required to regulate the concentration of the aqueous gelatin solution so as to achieve the desired twinning probability. When the aqueous silver salt solution and the aqueous halide solution are mixed, it is preferred to chose the gelatin concentration such that the amount of gelatin is 0.4 g or less, and more preferably 0.3 g or less per gram of silver. In the nucleation, since a very dilute reaction solution is used, there may be the case where the protective colloid is not needed. Tabular nucleation free from gelatin is also preferred.

In the case where the silver halide fine grains continuously formed by the invention are utilized in the crystal growth, it is preferred that the added silver halide grains are rapidly dissolved. Since normal crystal nuclei are readily dissolved as compared with twin crystal nuclei, it is preferred that the amount of the twin crystal nuclei is low. On the other hand, when the concentration of the aqueous gelatin solution is high during the formation of grains, the twinning probability is low. Accordingly, it is preferred that the gelatin concentration is high. It is preferred to add gelatin such that the concentration of the aqueous gelatin solution is from 0.2 g to 1 g, more preferably from 0.3 g to 1 g, and most preferably from 0.4 g to 1 g per gram of silver nitrate to be added.

When the concentration of gelatin is too high, the viscosity of the aqueous gelatin solution increases so that its addition becomes difficult. By making the molecular weight of gelatin low by means of enzymatic decomposition, etc., it is possible to lower the viscosity. The molecular weight of gelatin is preferably from 1,000 to 100,000, more preferably from 1,000 to 50,000, and most preferably from 1,000 to 30,000.

In the case where the silver halide fine grains as continuously formed by the invention are utilized in the crystal growth, the gelatin that is added along with the silver halide grains influences the thickness of the tabular silver halide grains. The influence against the thickness of the tabular silver halide grains kept within the reaction can be widely changed by chemical modification of gelatin. In order to obtain thin tabular silver halide grains, oxidized gelatin, phthalated gelatin, succinated gelatin, or trimellitated gelatin can be preferably used.

Upon addition of the fine grains formed using the mixer of the invention as an external mixer to grains in the reactor, it is possible to grow the grains in the reactor. The fine grains formed by the mixer of the invention are fine in size as compared with the silver halide grains kept in the reactor. Accordingly, the fine grains have a high solubility and are dissolved by Ostwald ripening to become silver ions and halide ions, whereby they are accumulated on the silver halide grains having a larger size in the reactor to cause the growth of grains. One of the characteristic features of this growth method resides in the matter that since the addition of silver or halide ions to the reactor is not performed, a high supersaturation region is not formed in the vicinity of the addition port. It is known that when tabular silver halide grains pass through the high supersaturation region, their thickness increases. Such will be a great obstacle on the formation of tabular silver halide grains having a large specific surface area.

In the preparation of tabular silver halide grains by the addition method of fine grains, in the case where the size of the added fine grains is large, the larger the size, the lower the equilibrium solubility is. Thus, the fine grains are liable to remain without being dissolved. This problem might possibly be resolved by lowering the rate of the fine grains to be added, i.e., lowering the addition amount of silver per unit time. However, this will take a long period of time for manufacture, and hence, is not efficient. Further, in order to shorten the manufacture time, it is desired to make the addition amount of silver per unit time high. However, in the addition method of fine grains, when the addition amount of silver per unit time is made high, the formation of residual fine grains occurs. Such tendency is remarkable when the size of fine grains is large. Accordingly, in order to achieve a high efficiency, it is necessary that the size of fine grains be properly small such that the fine grain emulsion has a high concentration and does not remain without being dissolved.

Further, in the case where the distribution of the fine grains to be added is polydispersed, there may be found a phenomenon where after the addition, ripening occurs among grains having a large difference in size, resulting in the presence of fine grains having a large size, and such fine grains remain without being dissolved. Thus, it is desirable that the fine grains to be added be monodispersed.

Accordingly, in order to prepare thin tabular silver halide grains with a high efficiency, fine grain emulsions that have a high concentration, are properly small in size and are monodispersed are required. A molar concentration of the silver halide contained in the silver halide fine grain emulsion of the invention is 0.5 mol/L or more, and preferably 1 mol/L or more. Further, a number average equivalent circular diameter of the silver halide fine grains is preferably 15 nm or less, more preferably 10 nm or less, and still more preferably 8 nm or less. Moreover, preferably, the silver halide fine grains are monodispersed such that a coefficient of variation of the equivalent circular diameter thereof is preferably 30% or less, more preferably 25% or less, still more preferably 20% or less, and especially preferably 10% or less.

In the case where many fine grains having a twin crystal are contained in the fine grain emulsion, the fine grains are liable to remain. Thus, in the case where the fine silver halide emulsion is used for the purpose of growing tabular silver halide grains, it is desired that a rate of the number of twin crystal grains in the whole of the fine grains is low. In the invention, the rate is preferably 15% or less, more preferably 10% or less, and still more preferably 5% or less.

In addition, it is preferred from the viewpoint of productivity to use high-concentration silver salt solution and halide solution. However, as the concentration increases, even when the gelatin concentration is made high, for example, the gelatin concentration is 1.6 g per gram of silver nitrate to be added, coagulation of the grains occurs. It is difficult to increase the gelation concentration any more because even low-molecular weight gelatin also causes increase of viscosity. With respect to such a problem, according to the invention, by controlling the pBr at a certain constant value at mixing the aqueous silver salt solution and the aqueous halide-solution, it is possible to prepare the desired silver halide fine grain emulsion without causing the coagulation of the silver halide fine grains even when the gelatin concentration is not higher than 1.6 g per gram of silver nitrate to be added. In the invention, the pBr value at mixing the aqueous silver salt solution and the aqueous halide solution is preferably from 1.0 to 5.0, and more preferably from 1.5 to 3.5.

It is preferred to mix the aqueous silver salt solution and the aqueous halide solution within a short period of time. A mixing time in the mixer is preferably 0.5 seconds or shorter, and most preferably 0.1 seconds or shorter. Further, in the process of the invention, after the aqueous silver salt solution and the aqueous halide solution collide with each other in the mixer, it is possible to appropriately regulate a time until the formed silver halide grains meet the silver halide emulsion in the reactor (hereinafter referred to as "ΔT"). This time can be simply calculated from a diameter of a capillary as the mixer and a flow rate of the aqueous solution desired grain size by ripening the formed fine grains. In the case where it is necessary to make the fine grain size minimum, ΔT is preferably 1 second or shorter, and more preferably 0.5 seconds or shorter.

During mixing of the aqueous silver salt solution and the aqueous halide solution, it is preferred that mechanical stirring is not accompanied. When the mechanical stirring is accompanied, it is difficult to realize mixing without causing circulation. Further, in the case where the mixing time is short as 0.1 seconds or shorter, it is difficult to undergo sufficient mixing by the mechanical stirring.

The equivalent circular diameter of silver halide fine grain can be determined directly by an electron microscope and is determined as a diameter of a circle having an equivalent projected area. Because of fine grains, the size of the fine grains is liable to increase due to the ripening. Accordingly, the fine grains to be added are observed after stopping the change in grain with a ripening inhibitor or a growth inhibitor. Alternatively, the silver halide fine grains to be added are immediately placed on a mesh for electron microscopic observation and after immediately removing the moisture, are observed. By performing the electron microscopic observation at a temperature of −100° C. or lower, the observation of the silver halide fine grains becomes easy. With respect to 1,000 or more grains, the equivalent circular diameter is determined, whereby a number average equivalent circular diameter and a coefficient of variation of the equivalent circular diameter can be determined. Further, the twinning probability (a rate of the number of twin crystal grains) of the silver halide fine grains can be determined by growing a fine grain emulsion at a temperature of 40° C. or lower, and preferably 35° C. or lower to a degree such that it exhibits a definite grain shape under a high supersaturation condition without generation of new nuclei and observing transmission electron microscopic photographic images of replicas of the grains. The details can be referred to the description of JP-A-2-146033.

The silver halide emulsion of the invention may be of tabular grains having a (100) face or tabular grains having a (111) face, but is preferably of tabular grains having a (111) face. Further, the composition of the silver halide emulsion is preferably silver bromide, silver iodobromide, silver chlorobromide, or silver chloroiodobromide.

The silver halide photographic emulsion of the invention contains tabular silver halide grains having an aspect ratio of 5 or more, preferably 8 or more, more preferably 10 or more, and still more preferably 20 or more. Further, the thickness of the tabular silver halide is preferably 0.2 μm or less, more preferably 0.15 μm or less, and still more preferably 0.1 μm or less. The equivalent circular diameter and thickness of the tabular silver halide grains can be determined by a well-known method (electron microscopic method using shadow-cast replica).

Further, with respect to chemical sensitization and spectral sensitization of the silver halide emulsion of the invention and silver halide photographic light-sensitive materials using the silver halide emulsion, known configurations can be utilized. Moreover, with respect to doping of the silver halide emulsion grains of the invention with a metal complex and growth of epitaxial segment thereof, known configurations can be also utilized.

The invention will be described with reference to the following Examples.

EXPERIMENT 1

(Preparation of Fine Grain Emulsions a, b and c)

An aqueous solution (first solution) prepared by dissolving 480 g of $AgNO_3$ in water to make 3,000 mL and an aqueous solution (second solution) prepared by dissolving an equimolar amount of KBr and 288 g of oxidized gelatin having a low molecular weight as 15,000 in water to make 3,000 mL were introduced into a mixer as shown in FIG. 2, to prepare a fine grain emulsion. Introduction port 2 was provided at position a, b or c schematically shown in FIG. 2. The first solution set up at 24° C. was introduced as a jet flow into a slowing-down region 5 from an introduction port 1 as shown in FIG. 2. At the time when the jet flow came into the slowing-down region, its flow velocity in the Z direction was set up at 360 m/sec. The inner diameter of the introduction port 1 is 0.13 mm. The second solution set up at 20° C. was introduced from the introduction port 2. The inner diameter of the introduction port 2 was 1.3 mm, and the introduction velocity of the second solution was 3.6 m/sec. The slowing-down region has a cylindrical shape having a diameter of 4 mm, and a discharge port 4 has a diameter of 2.0 mm.

A Z component of the jet flow velocity in the position (Z coordinate) of introduction port a, b or c was examined by the numerical flow analysis using the finite difference method (using Analysis Code R-FLOW, manufactured by R-Flow Co., Ltd.) As a result, the flow velocity was 300 m/sec at the position of the introduction port a, 40 m/sec at the position of the introduction port b and 5 m/sec at the position of the introduction port c, respectively. The eddy viscosity exhibited the maximum value between the positions of introduction ports b and c.

The silver halide fine grains discharged from the discharge port were observed using a transmission electron microscope capable of cooling a specimen, and the results obtained are shown in Table 1. As is clear from the results as shown in Table 1, small-size monodispersed fine grain emulsions (the emulsions a and b) can be prepared according the production process of the invention. On the other hand, in the emulsion c for comparison wherein the second solution was introduced after the jet flow velocity had thoroughly slowed down, the average grain size was large and the monodispersity was inferior.

TABLE 1

| Emulsion | Position of Introduction Port | Number Average Equivalent Circular Diameter (μm) | Coefficient of Variation (%) | Remarks |
|---|---|---|---|---|
| a | a | 0.008 | 17 | Invention |
| b | b | 0.010 | 23 | Invention |
| c | c | 0.015 | 29 | Comparison |

EXPERIMENT 2

(Preparation of Fine Grain Emulsions d, e and f)

Emulsions d, e and f were prepared in the same manner as in Experiment 1, except that the velocity of the jet flow (first solution) to be introduced from the introduction port 1 into the slowing-down region was changed to 36 m/sec and that the velocity of the second solution to be introduced from the introduction port 2 was changed to 0.36 m/sec. Thereafter, the same analysis as in Experiment 1 was carried out. As a result, the Z component of the jet flow velocity in the position (Z coordinate) of the introduction port a, b or c was 29 m/sec at the position of the introduction port a, 4.5 m/sec at the position of the introduction port b and 0.3 m/sec at the position of the introduction port c, respectively. The results of observation of the shape of the grains contained in the emulsions by an electron microscope are shown in Table 2. Even in the case where the jet flow velocity is low, the effects of the invention can be achieved as is apparent from the emulsions d and e. On the other hand, in the emulsion f wherein the second solution was introduced after the jet flow velocity had thoroughly slowed down, the distribution of the silver halide grains became greatly worse. Thus, it is noted that the effects of the invention are especially effective in the case of a low flow velocity (low pressure).

TABLE 2

| Emulsion | Position of Introduction Port | Number Average Equivalent Circular Diameter (μm) | Coefficient of Variation (%) | Remarks |
|---|---|---|---|---|
| d | a | 0.008 | 17 | Invention |
| e | b | 0.011 | 24 | Invention |
| f | c | 0.019 | 35 | Comparison |

EXAMPLE 1

(Preparation of Tabular Emulsions g and h)

In a reactor were added 4.0 L of water, 20 g of oxidized bone gelatin having an average molecular weight of 20,000 (methionine content: 5 μmol/g) and 4 g of KBr to dissolve. To the solution kept at 35° C. in the reactor were added 80 mL of a 0.29 M aqueous silver nitrate solution and 80 mL of a 0.29 M aqueous KBr solution over a period of 40 seconds while stirring (nucleation).

The temperature was elevated from 35° C. to 75° C. over a period of 25 minutes, and the mixture was allowed to stand for 2 minutes. Thereafter, 600 mL of a 10 weight % bone gelatin solution, in which 95% of amino groups had been succinated, and KBr were added to adjust the pBr of the emulsion in the reactor at 2.7 (ripening).

Then, to the ripened emulsion was continuously added the emulsion d (or the comparative emulsion f) of Experiment 2 over a period of 60 minutes. After completion of the addition, the mixture was further ripened for 15 minutes, the temperature was lowered to 40° C., and the resulting mixture was subjected to desalting by a conventional flocculation method. The characteristics of the resulting tabular emulsions are shown in Table 3. In the case where the emulsion was formed by using the fine grains (the emulsion d) of the invention, the tabular grains having a large aspect ratio were obtained, as compared with the case where the comparative emulsion f was added. Further, the added fine grains did not remain. This is because the emulsion d is made of monodispersed grains. The remains of the added grains bring about deterioration in emulsion performance such as unevenness of chemical sensitization or spectral sensitization (see Example 2 below).

TABLE 3

| Tabular Emulsion | Fine Emulsion | Average Tabular Thickness (μm) | Number Average Equivalent Circular Diameter (μm) | Variation Coefficient of Equivalent Circular Diameter (%) | Remains of Fine Grains | Remarks |
|---|---|---|---|---|---|---|
| g | d | 0.055 | 1.54 | 32 | No | Invention |
| h | f | 0.056 | 1.47 | 33 | Yes | Comparison |

EXAMPLE 2

The tabular emulsions g and h were subjected to chemical sensitization and spectral sensitization in the same manner as described in Example 1 of JP-A-5-346631, and the photographic performances were compared. The tabular emulsion g of the invention had high sensitivity and hard gradation as compared with the emulsion h. The reason for this is considered that the emulsion g has a high aspect ratio and no remaining fine grains.

According to the invention, a silver halide photographic emulsion containing monodispersed tabular silver halide grains, especially thin and monodispersed tabular silver halide grains can be obtained. Further, a high-sensitive photographic light-sensitive material can be obtained by using the silver halide photographic emulsion containing such tabular silver halide grains.

The entire disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A process of producing a silver halide photographic emulsion containing tabular silver halide grains having an aspect ratio of 5 or more, which comprises using silver halide fine grains as prepared by the following method in at least one of a nucleation step and a growth step of the production of silver halide emulsion, the method comprising mixing at least a silver salt aqueous solution and a halide aqueous solution to prepare silver halide fine grains, wherein one of the silver salt aqueous solution and the halide aqueous solution is introduced as a jet flow into a mixer; a region where the jet flow slows down is provided within the mixer; and the other solution is introduced into the jet flow before the velocity of the jet flow has become 1/10 of the velocity at the time when the jet flow comes into the slowing-down region.

2. A process of producing a silver halide photographic emulsion containing tabular silver halide grains having an aspect ratio of 5 or more, which comprises using silver halide fine grains as prepared by the following method in at least one of a nucleation step and a growth step of the production of silver halide emulsion, the method comprising introducing at least two solutions into a mixer to prepare silver halide fine grains, wherein the mixer is provided with at least two introduction ports and at least one discharge port; a first solution is introduced as a jet flow from a first introduction port; the mixer is provided with a region where the jet flow slows down; a second solution is introduced from a second introduction port as a flow having a vector in the vertical direction to the jet flow of the first solution; an inner diameter of the mixer is larger than an inner diameter of each of the introduction ports to generate the maximum velocity of each of the introduced solutions; the discharge port of the mixer has an inner diameter smaller than the inner diameter of the mixer; and the introduction port of the second solution is provided in a position at which a velocity Vz of the jet flow of the first solution in the direction (Z direction) where the jet flow of the first solution introduced exhibits the maximum velocity meets the following requirement:

$$(1/10)Vz0<Vz<Vz0$$

wherein Vz0 represents a velocity in the Z direction when the jet flow comes into the slowing-down region.

3. A process of producing a silver halide photographic emulsion containing tabular silver halide grains having an aspect ratio of 5 or more, which comprises using silver halide fine grains as prepared by the following method in at least one of a nucleation step and a growth step of the production of silver halide emulsion, the method comprising introducing at least two solutions into a mixer to prepare silver halide fine grains, wherein a first solution is introduced as a jet flow; and a second solution is introduced before the eddy viscosity of the jet flow becomes maximum.

4. The process of producing a silver halide photographic emulsion according to claim 1, wherein the silver halide fine grains have a number average equivalent circular diameter of 15 nm or less and a variation coefficient of the equivalent circular diameter of 30% or less.

5. The process of producing a silver halide photographic emulsion according to claim 1, wherein the silver halide fine grains have a rate of number of twin crystal grains of 15% or less.

6. The process of producing a silver halide photographic emulsion according to claim 2, wherein the silver halide fine grains have a number average equivalent circular diameter of 15 nm or less and a variation coefficient of the equivalent circular diameter of 30% or less.

7. The process of producing a silver halide photographic emulsion according to claim 2, wherein the silver halide fine grains have a rate of number of twin crystal grains of 15% or less.

8. The process of producing a silver halide photographic emulsion according to claim 3, wherein the silver halide fine grains have a number average equivalent circular diameter of 15 nm or less and a variation coefficient of the equivalent circular diameter of 30% or less.

9. The process of producing a silver halide photographic emulsion according to claim 3, wherein the silver halide fine grains have a rate of number of twin crystal grains of 15% or less.

10. The process of producing a silver halide photographic emulsion according to claim 1, wherein the silver halide fine grains have a molar concentration of 0.5 mol/L or more.

11. The process of producing a silver halide photographic emulsion according to claim 1, wherein when two kinds of the solutions are mixed, a Br ion concentration pBr is controlled.

12. The process of producing a silver halide photographic emulsion according to claim 11, wherein the pBr is from 1.0 to 5.0.

13. The process of producing a silver halide photographic emulsion according to claim 2, wherein the silver halide fine grains have a molar concentration of 0.5 mol/L or more.

14. The process of producing a silver halide photographic emulsion according to claim 2, wherein when two kinds of the solutions are mixed, a Br ion concentration pBr is controlled.

15. The process of producing a silver halide photographic emulsion according to claim 3, wherein the silver halide fine grains have a molar concentration of 0.5 mol/L or more.

16. The process of producing a silver halide photographic emulsion according to claim 3, wherein when two kinds of the solutions are mixed, a Br ion concentration pBr is controlled.

17. A silver halide photographic emulsion produced by the process according to claim 1.

* * * * *